US008615970B2

(12) United States Patent
Hoberman et al.

(10) Patent No.: US 8,615,970 B2
(45) Date of Patent: Dec. 31, 2013

(54) PANEL ASSEMBLIES HAVING CONTROLLABLE SURFACE PROPERTIES

(76) Inventors: Charles Hoberman, New York, NY (US); Matthew Davis, Newtown, PA (US); Zygmunt Joseph Drozdowski, Brooklyn, NY (US); David Wight, Montclair, NJ (US)

( * ) Notice: Subject to any disclaimer, the term of this patent is extended or adjusted under 35 U.S.C. 154(b) by 575 days.

(21) Appl. No.: 12/729,598

(22) Filed: Mar. 23, 2010

(65) Prior Publication Data

US 2010/0243180 A1 Sep. 30, 2010

Related U.S. Application Data

(60) Provisional application No. 61/162,901, filed on Mar. 24, 2009.

(51) Int. Cl.
*E04C 2/54* (2006.01)

(52) U.S. Cl.
USPC ..... 52/787.1; 52/64; 49/87.1; 49/118; 49/128; 160/187; 160/222

(58) Field of Classification Search
USPC ..... 52/64, 65, 69, 171.1, 202, 203, 786.1, 52/787.1; 49/73.1, 74.1, 77.1, 79.1, 80.1, 49/81.1, 87.1, 98, 103, 116, 117, 118, 49/128–130; 160/183–187, 199, 200, 203, 160/220, 222, 223, 161, 128–132, 237
See application file for complete search history.

(56) References Cited

U.S. PATENT DOCUMENTS

| | | | | | |
|---|---|---|---|---|---|
| 275,557 | A | * | 4/1883 | Williams | 160/136 |
| 663,994 | A | * | 12/1900 | Kuhlman | 49/51 |
| 1,612,771 | A | * | 12/1926 | Pfeiffer | 52/669 |
| 3,382,630 | A | * | 5/1968 | Chivers | 52/208 |
| 3,444,919 | A | * | 5/1969 | Karoll | 160/184 |
| 3,685,040 | A | * | 8/1972 | Hart | 345/109 |
| 4,020,889 | A | * | 5/1977 | Karoll | 160/120 |
| 4,053,340 | A | * | 10/1977 | Work | 156/70 |
| 4,384,429 | A | * | 5/1983 | Rokicki et al. | 49/130 |
| 4,706,419 | A | * | 11/1987 | Adachi et al. | 52/65 |
| 4,780,344 | A | | 10/1988 | Hoberman | |
| 4,846,244 | A | * | 7/1989 | Rosenfeld | 160/201 |
| 4,942,700 | A | | 7/1990 | Hoberman | |
| 4,981,732 | A | | 1/1991 | Hoberman | |
| 5,155,936 | A | * | 10/1992 | Johnson | 49/38 |
| 5,234,727 | A | | 8/1993 | Hoberman | |
| 5,664,613 | A | * | 9/1997 | Jelic | 160/84.05 |
| 6,082,056 | A | | 7/2000 | Hoberman | |
| 6,119,409 | A | * | 9/2000 | Makar et al. | 52/67 |

(Continued)

FOREIGN PATENT DOCUMENTS

JP 2001-011988 1/2001

*Primary Examiner* — Joshua J Michener
*Assistant Examiner* — Theodore Adamos
(74) *Attorney, Agent, or Firm* — Gottlieb, Rackman & Reisman, P.C.

(57) ABSTRACT

An assembly comprised of at least one fixed panel and at least two moveable panels is provided. The moveable panels are capable of being controllably shifted relative both to each other and to the fixed panel such that first and second aligned and non-aligned positions can be achieved. The assembly is further comprised of two or more drive links which are, in turn, comprised of a center pivot which engages with the fixed panel and two or more outer pivots which engage with the movable panels.

17 Claims, 15 Drawing Sheets

(56) References Cited

U.S. PATENT DOCUMENTS

| | | | | |
|---|---|---|---|---|
| 6,138,434 | A * | 10/2000 | Demars et al. | 52/786.13 |
| 6,190,231 | B1 | 2/2001 | Hoberman | |
| 6,219,974 | B1 | 4/2001 | Hoberman | |
| 6,367,203 | B1 * | 4/2002 | Graham et al. | 52/1 |
| 6,430,894 | B1 * | 8/2002 | Chae et al. | 52/786.1 |
| 6,651,720 | B1 | 11/2003 | Disilvestro et al. | |
| 6,739,098 | B2 | 5/2004 | Hoberman et al. | |
| 6,834,465 | B2 | 12/2004 | Hoberman et al. | |
| 6,877,546 | B1 * | 4/2005 | Garcia | 160/134 |
| 7,100,333 | B2 | 9/2006 | Hoberman et al. | |
| 7,125,015 | B2 | 10/2006 | Hoberman et al. | |
| 7,413,616 | B2 * | 8/2008 | Breiling et al. | 134/32 |
| 7,464,503 | B2 | 12/2008 | Hoberman et al. | |
| 7,540,215 | B2 | 6/2009 | Hoberman et al. | |
| 7,559,174 | B2 | 7/2009 | Hoberman et al. | |
| 7,584,777 | B2 * | 9/2009 | Hoberman et al. | 160/218 |
| 7,637,063 | B2 * | 12/2009 | Sensini | 52/302.1 |
| 7,644,721 | B2 | 1/2010 | Hoberman et al. | |
| 7,811,023 | B2 * | 10/2010 | Marche | 403/150 |
| 2002/0083675 | A1 | 7/2002 | Hoberman | |
| 2004/0041433 | A1 | 3/2004 | Sturt et al. | |
| 2004/0134157 | A1 | 7/2004 | Hoberman | |
| 2005/0097832 | A1 | 5/2005 | Hoberman et al. | |
| 2006/0102296 | A1 * | 5/2006 | Wu | 160/223 |
| 2007/0007289 | A1 | 1/2007 | Hoberman | |
| 2007/0012348 | A1 | 1/2007 | Hoberman | |
| 2007/0125504 | A1 | 6/2007 | Early et al. | |
| 2007/0235150 | A1 * | 10/2007 | Hoberman et al. | 160/218 |
| 2007/0266648 | A1 | 11/2007 | Hoberman | |

* cited by examiner

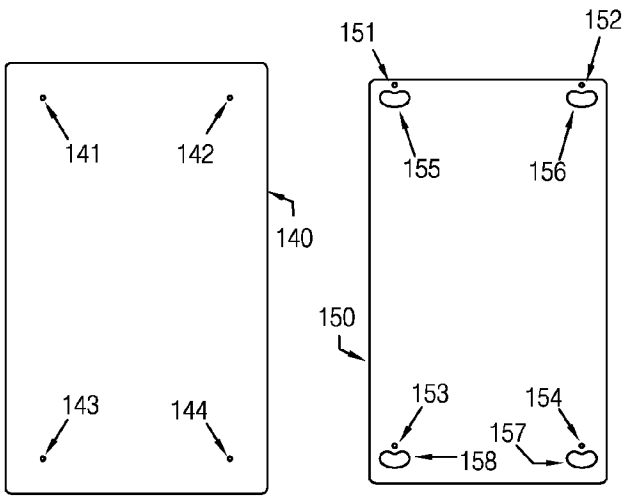
FIG.15
FIG.16
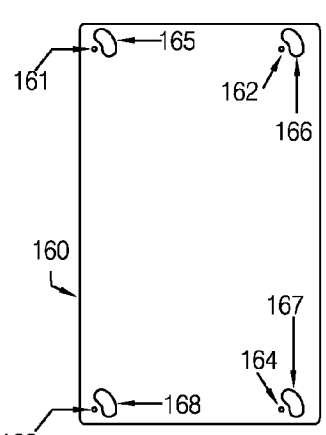
FIG.17
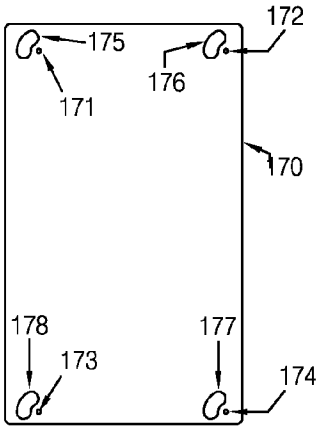
FIG.18
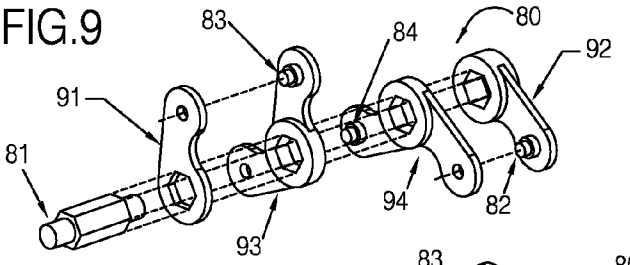
FIG.9
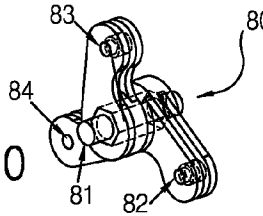
FIG.10
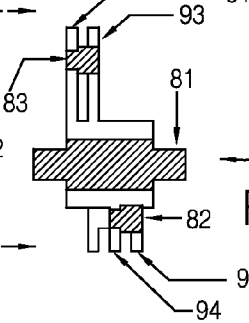
FIG.12
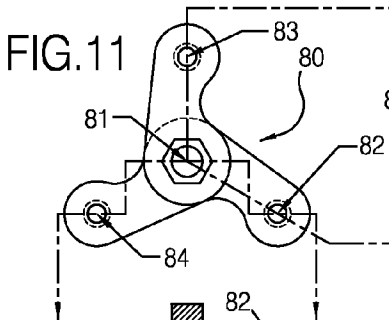
FIG.11
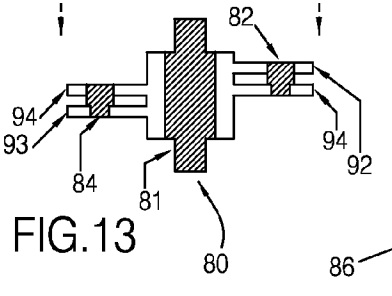
FIG.13
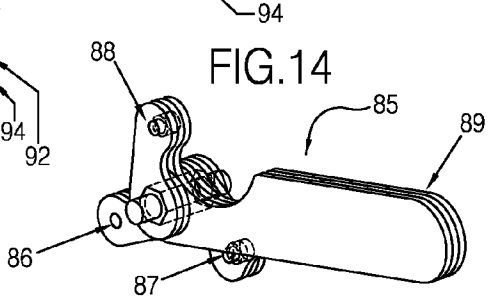
FIG.14

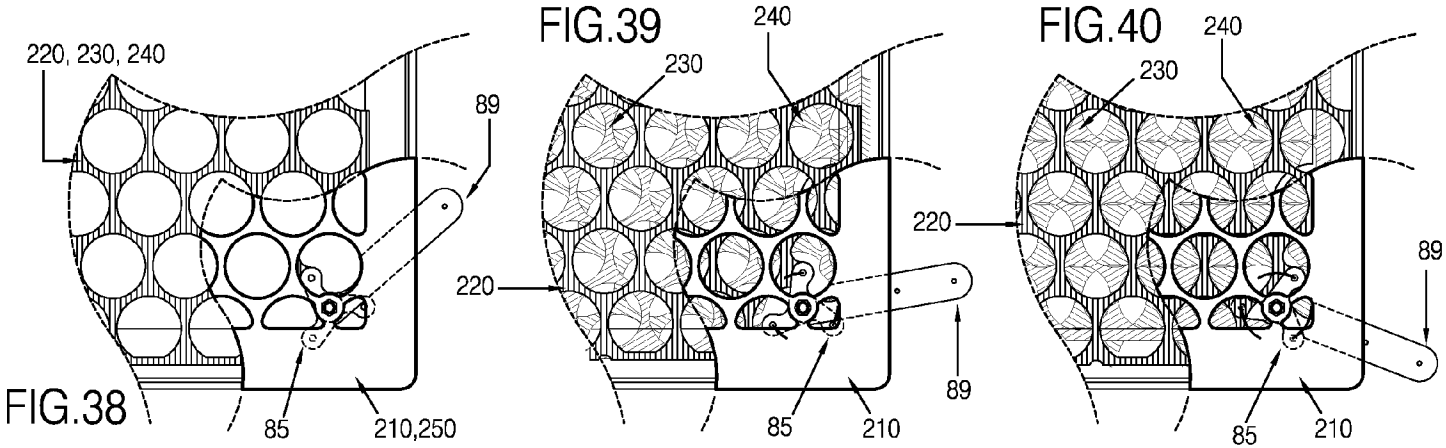
FIG.38
FIG.39
FIG.40
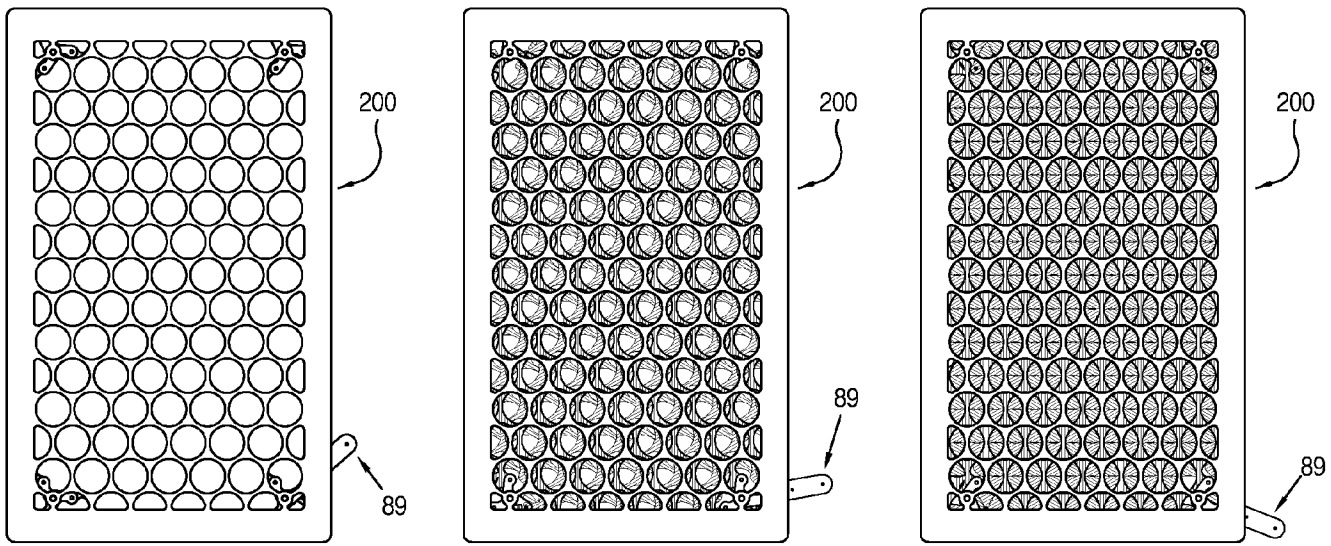
FIG.41
FIG.42
FIG.43

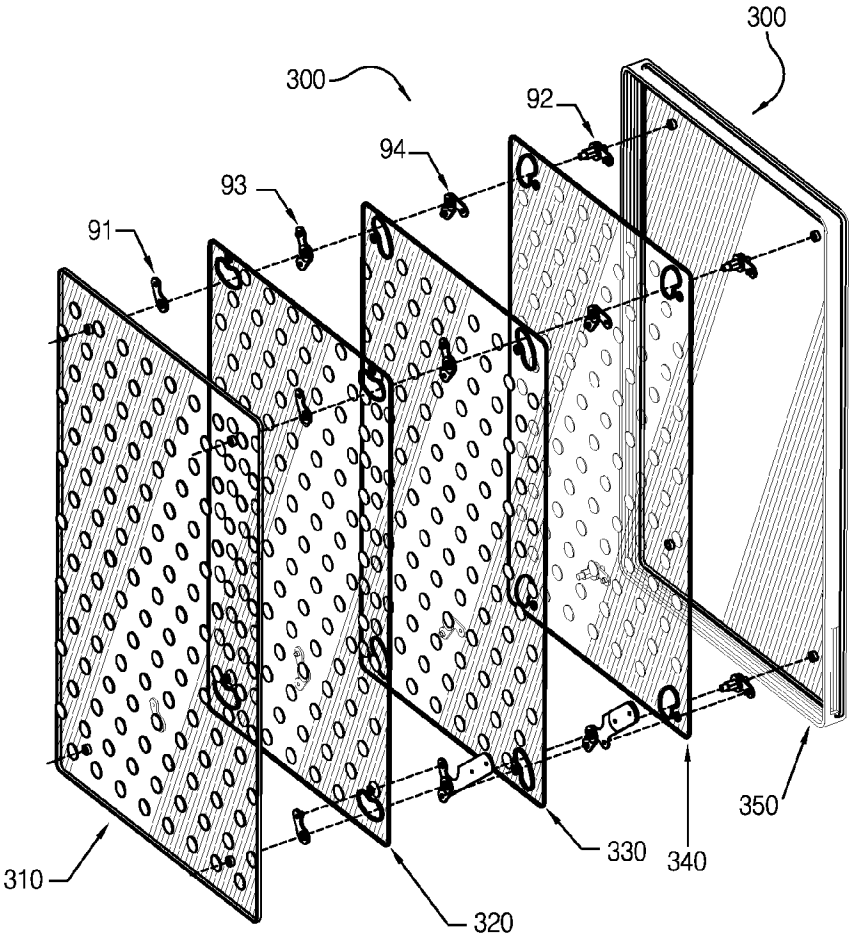
FIG.48
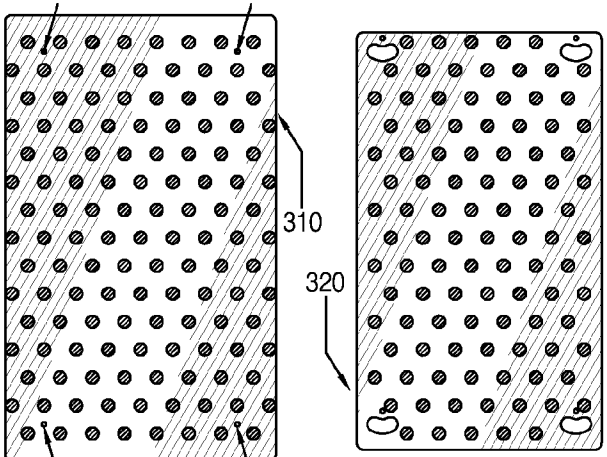
FIG.44
FIG.45
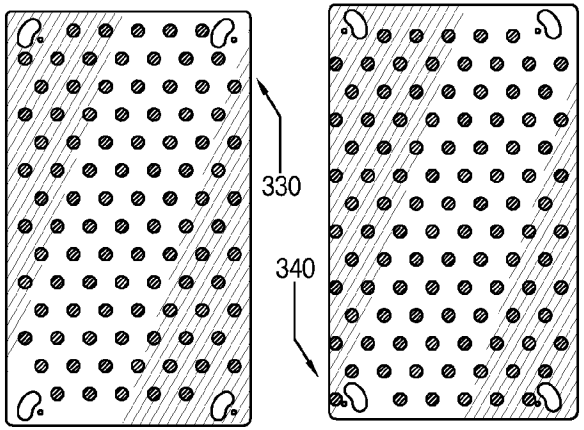
FIG.46
FIG.47

320,330,340
89
310,350

320
330
340
310,350
89

320
330
340
310,350
89

300

300

300

PANEL ASSEMBLIES HAVING CONTROLLABLE SURFACE PROPERTIES

This invention relates to a unique type of panel assembly. The application claims priority benefit of U.S. Provisional Application No. 61/162,901, filed Mar. 24, 2009.

BACKGROUND OF THE INVENTION

The façade of a building plays a central role in a building's environmental performance, influencing energy usage by determining how light, heat and air are exchanged with its surroundings. As one example, the interlocking systems that comprise curtain walls for high-rise buildings: structural, glazing, insulation, ventilation and shading, all play a role in managing the energy flows between interior and exterior.

One key strategy to achieve sustainable performance is for buildings to actively adapt and respond to changing climatic conditions. This strategy may be applied to facades in different ways. For example, an adaptive façade may have operable elements such as shades that extend and retract automatically. Those devices can respond to environmental data (i.e. temperature, light intensity and wind flow) gathered from sensors, and, utilizing computational intelligence, the building can optimize its environmental configuration for different environmental conditions.

This concept of a responsive facade has been termed "intelligent skin" indicating the analogy with natural systems.

A significant portion of the façade is comprised of windows—or more generally, glazed areas. Static methods are often used to set the light transmissivity of glass. Ceramic fritting is widely utilized where a graphic pattern is applied to glass in order to block some light transmission, yet still allowing sufficient transparency for viewing. However, standard ceramic fritting is static and does not respond to changing conditions.

By integrating responsive controls with fritted glass surfaces, improved light control and decreased energy usage can be achieved.

An adaptive window could, for example, allow solar gain during cold weather, yet block the sun when it is warm. Natural light within the building can be maintained at desirable levels. Controllable transparency can also be used to allow visual contact when needed, yet provide privacy under other circumstances.

Beyond transparency control, a physical surface that can adjust its permeability, thereby controlling the passage of air, moisture or heat, provides additional benefits. Utilizing an exterior layer having controllable permeability, energy from the environment may be accepted or blocked as needed.

Currently, such adaptive control within the facade is achieved with standard products such as blinds, shades or curtains. Beyond traditional devices, a new generation of adaptive glass technology is available such as 'switchable' and 'electrochromic' glass. However, these technologies have not received wide acceptance to date.

The invention disclosed herein provides new methods to provide surfaces having controllable properties. Such properties include transparency, permeability and acoustic performance. Surfaces that are formulated according to the disclosed invention may then be integrated into building façades as an 'adaptive layer' providing enhanced environmental performance.

SUMMARY OF THE INVENTION

An assembly comprised of at least one fixed panel and at least two moveable panels is provided. The moveable panels are capable of being controllably shifted relative both to each other and to the fixed panel such that first and second aligned and non-aligned positions can be achieved.

The assembly is further comprised of two or more drive links which are, in turn, comprised of a center pivot which engages with the fixed panel and two or more outer pivots which engage with the movable panels.

Also disclosed are fixed and movable panels that can be constructed from perforated sheets, or from transparent sheets which can have an applied graphic pattern. When the panel assembly is in its first position, these perforations, or graphic patterns, are aligned from sheet to sheet, providing a surface that is largely transparent and/or permeable. When the panel assembly is in its second position, the perforations or graphic patterns belonging to the different panels are not aligned, thereby providing a surface that is largely opaque and/or impermeable.

Accordingly, it is an object of the invention to provide surfaces having controllable properties.

Another object of the invention is to provide an improved surface in which the transparency, permeability and acoustic performance can be selectively controlled.

Still, other objects and advantages of the invention will, in part, be obvious and will, in part, be apparent from the following description.

BRIEF DESCRIPTION OF THE DRAWINGS

For a fuller understanding of the invention, reference is made to the following drawings in which:

FIG. 9 shows an exploded view of a third drive link of the invention;

FIG. 10 shows a perspective view of the inventive drive link of FIG. 9;

FIGS. 11-13 show successively a plan and two sectional views of the drive link of FIG. 9;

FIG. 14 shows a fourth drive link of the invention having a handle element;

FIGS. 15-18 show plan views of four panels of the invention;

FIGS. 38-40 shows cutaway views of the panel assembly of FIG. 34 as it is transformed from an initial, aligned position to a final non-aligned position.

FIGS. 41-43 shows plan views of the panel assembly of FIG. 34 as it is transformed from an initial, aligned position to a final non-aligned position;

FIGS. 44-47 show plan views of four additional panels of the invention which are transparent and have an applied graphic pattern;

FIG. 48 shows an exploded view of a fourth panel assembly of the invention;

DETAILED DESCRIPTION OF THE PREFERRED EMBODIMENT

Figure 1:
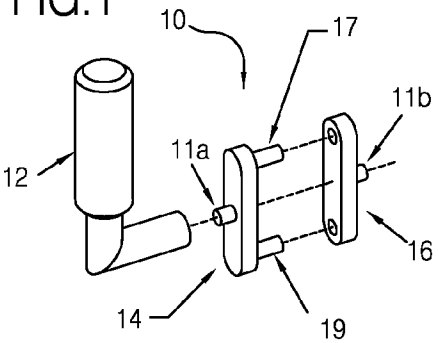
FIG. 1 shows an exploded view of a drive link of the invention.

FIG. 1 shows an exploded view of drive link 10 which is comprised of sub-links 14 and 16. Also shown are outer pivot pins 19 and 17, as well as center pivot pin 11*a* which is co-linear with center pivot pin 11*b*.

Figure 2:
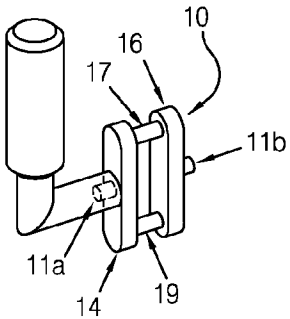
FIG. 2 shows a perspective view of the inventive drive link.

FIG. 2 shows a perspective view of drive link 10 in assembled form. It may be seen that outer pivot pins 19 and 17 span between sub-links 14 and 16. Also shown is center pivot pin 11*a* which is co-linear, yet discontinuous, with pivot pin 11*b*. Center pivot pin 11*a* is connected to a handle element 12.

Figure 3:
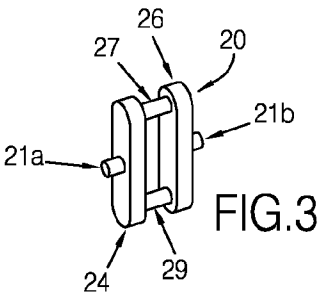
FIG. 3 shows a perspective view of a second drive link of the invention.

FIG. 3 shows drive link 20 which is comprised of sub-links 24 and 26 which, in turn, are connected by outer pivot pins 29 and 27. Sub-link 24 and sub-link 26 lie in different planes relative to one another. Outer pivots 29 and 27 span the depth of link 20. Also shown is center pivot pin 21*a* and center pivot pin 21*b* which are co-linear yet discontinuous.

Figure 4:
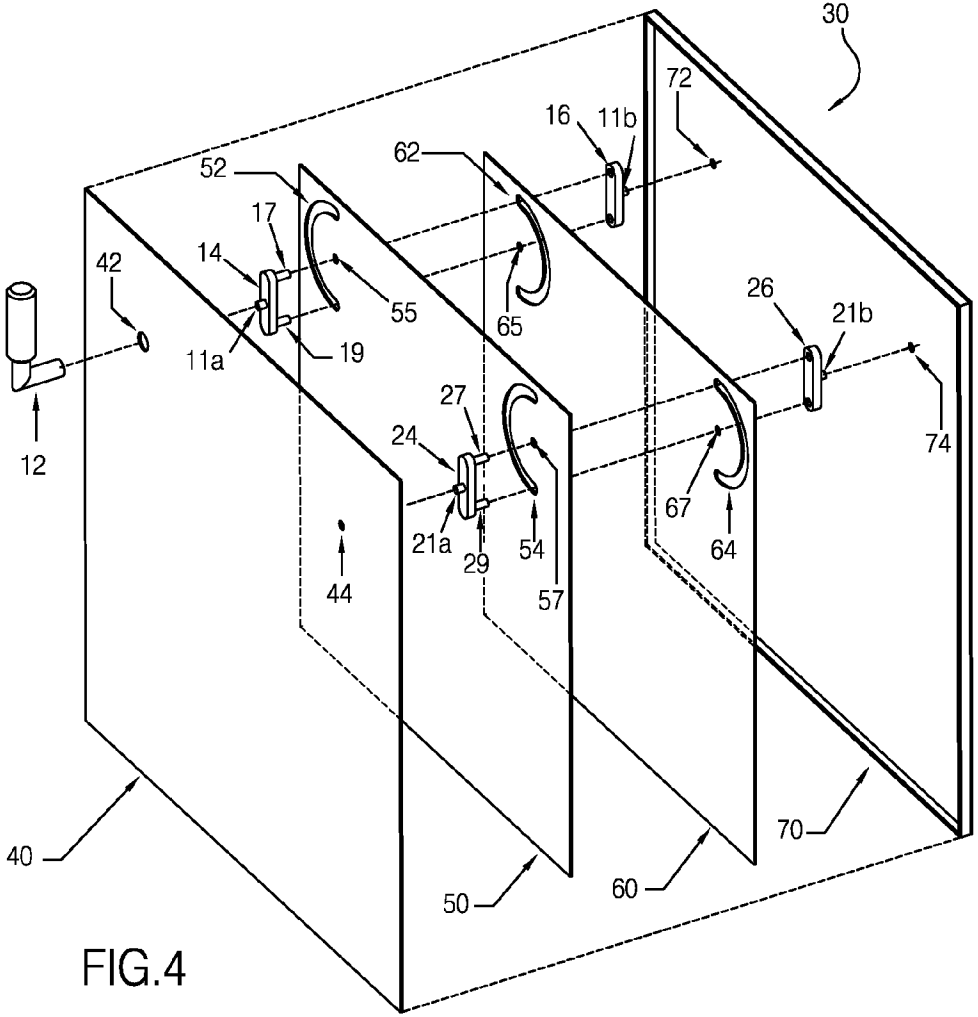
FIG. 4 shows an exploded view of a first panel assembly of the invention.

FIG. 4 shows an exploded view of panel assembly 30 which is comprised of two fixed panels 40 and 70 and two movable panels 50 and 60.

Front panel 40 has two pivot holes 42 and 44. Back panel 70 has two pivot holes 72 and 74 which are respectively aligned with and correspond to pivot holes 42 and 44. Center pivot pins 11*a* and 21*a* belonging to drive links 10 and 20 respectively are aligned with pivot holes 42,44 respectively; center pivot pins 11*b* and 21*b* belonging to drive links 10 and 20 respectively are aligned with pivot holes 72,74 respectively.

Panel 50 has two clearance slots 52 and 54 providing clearance for outer pivot pins 19 and 29 respectively. Panel 60 has two clearance slots 62 and 64 providing clearance for outer pivot pins 17 and 27 respectively.

Outer pivot pin 17 of drive link 10 is aligned with pivot hole 55 on panel 50. Outer pivot pin 19 of drive link 10 is aligned with pivot hole 65 on panel 60.

Outer pivot pin 27 of drive link 20 is aligned with pivot hole 57 on panel 50. Outer pivot pin 29 of drive link 20 is aligned with pivot hole 67 on panel 60.

Figure 5:
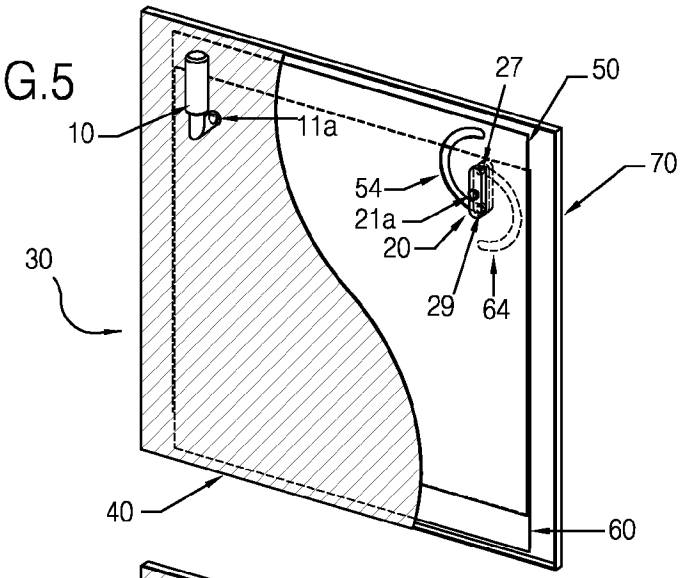

FIG. 5 shows panel assembly 30 in an initial position where movable panel 50 is in an upper location and movable panel 60 is in a lower location. Links 10 and 20 are pivotally connected to front panel 40 by center pivot pins 11*a* and 21*a* respectively.

Figure 6:
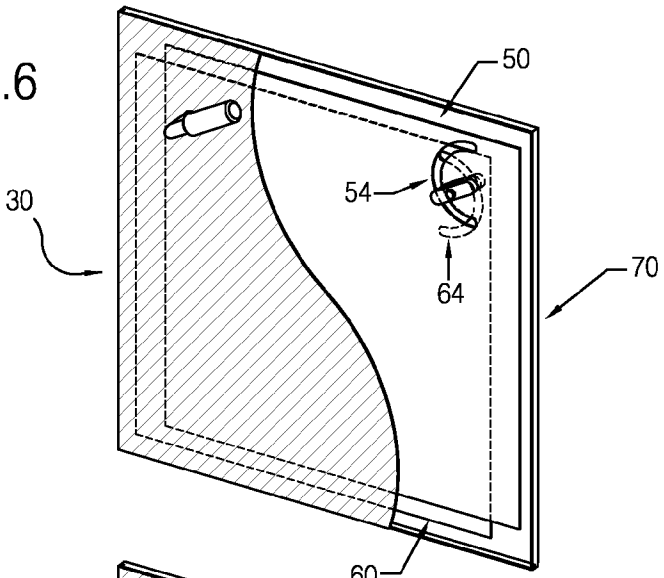
FIGS. 5-8 shows perspective views of the inventive panel assembly of FIG. 4 as it is transformed from an initial position to a final position.
Figure 7:
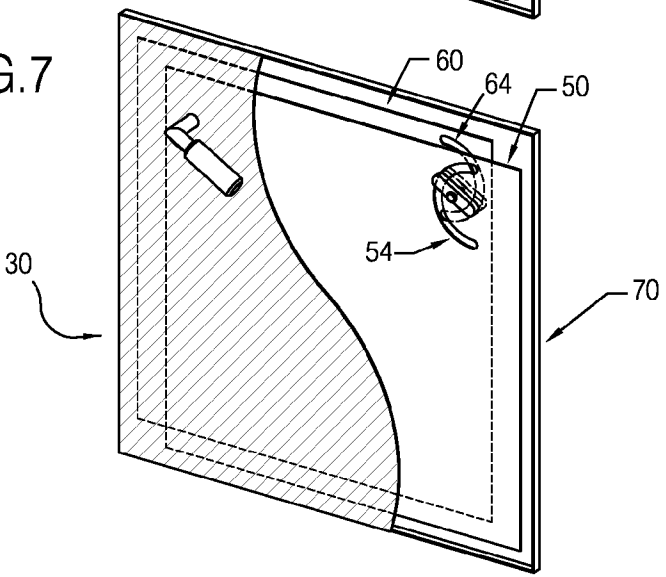

FIGS. 6 and 7 show panel assembly 30 in two intermediate positions whereby the relative locations of movable panels 50 and 60 are translated relative to their location in FIG. 5. Clearance slots 54 and 64 allow for outer pivot pins 27 and 29 to slidably move in an unobstructed manner.

It may be seen in FIGS. 5-7 that as panel 50 is successively lowered, panel 60 is successively raised. Thus, the movement of panel 50 counterbalances the movement of panel 60, thereby ensuring that the force needed to turn handle 12 is minimized.

Figure 8:
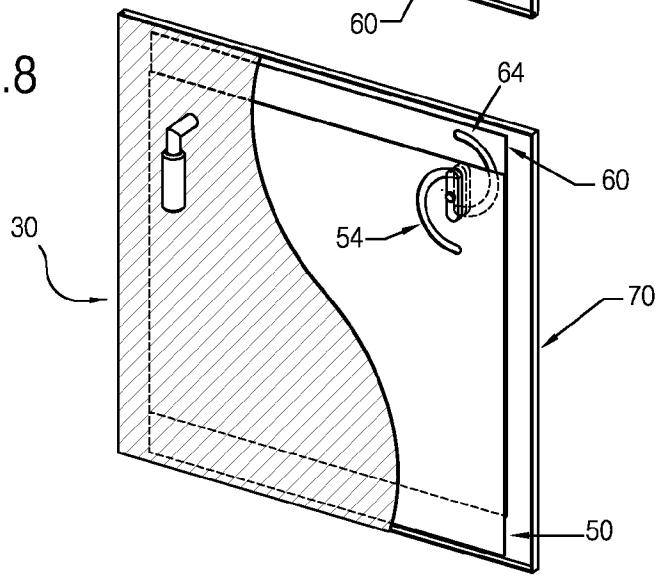

FIG. 8 shows panel assembly 30 in a final position where movable panel 50 is in a lower location and movable panel 60 is in an upper location.

FIG. 9 shows an exploded view of a drive link 80 which is comprised of a center pivot pin 81 and four sub-links 91, 92, 93 and 94. Sub-links 91,93 share outer pivot pin 83; sub-links 93,94 share outer pivot pin 84; sub-links 94,92 share outer pivot pin 82. Center pivot pin 81 has a hexagonal profile which mates with hexagonal openings in sub-links 91, 92, 93 and 94.

FIG. 10 shows a perspective view a drive link 80 wherein center pivot pin 81 is engaged in the hexagonal openings of the four sub-links, thereby fixing them to one another.

FIG. 11 shows drive link 80 in plan view.

FIG. 12 shows a sectional view of drive link 80. Outer pivot pin 83 connects sub-links 91 and 93; outer pivot pin 82 connects sub-links 92 and 94. Sub-link and sub-link 92 lie in different planes relative to one another. Likewise, outer pivot pins 82 and 83 each lie in different planes. Center pivot pin 81 spans the depth of link 80.

FIG. 13 shows a second sectional view of drive link 80. Outer pivot pin 84 connects sub-links 93 and 94.

It may be seen that center pivot pin 81 extends from the topmost to bottommost level of link 80, whereas outer pins 82, 83 and 84 extend only between adjacent sub-links 92,94 and 94,93 and 93,91 respectively.

FIG. 14 shows a drive link 85 which is similar to drive link 80, however, it also has a handle element 89.

FIG. 15 shows a panel 140 having four pivot holes 141, 142, 143 and 144.

FIG. 16 shows a panel 150 having four pivot holes 151, 152, 153 and 154 and four slots 155, 156, 157 and 158.

FIG. 17 shows a panel 160 having four pivot holes 161, 162, 163 and 164 and four slots 165, 166, 167 and 168.

FIG. 18 shows a panel 170 having four pivot holes 171, 172, 173 and 174 and four slots 175, 176, 177 and 178.

Figure 19:
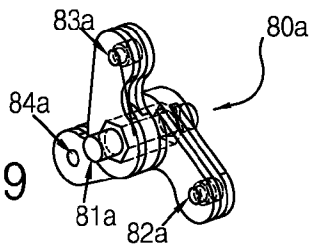
FIGS. 19-20 show perspective views of drive links of the invention in accordance with FIGS. 9 and 10.
Figure 20:
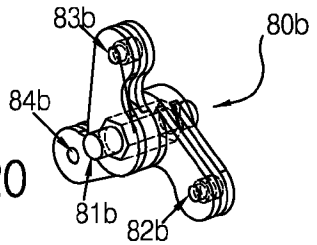

FIGS. 19 and 20 show drive links 80*a* and 80*b* which are essentially identical to drive link 80.

Figure 21:
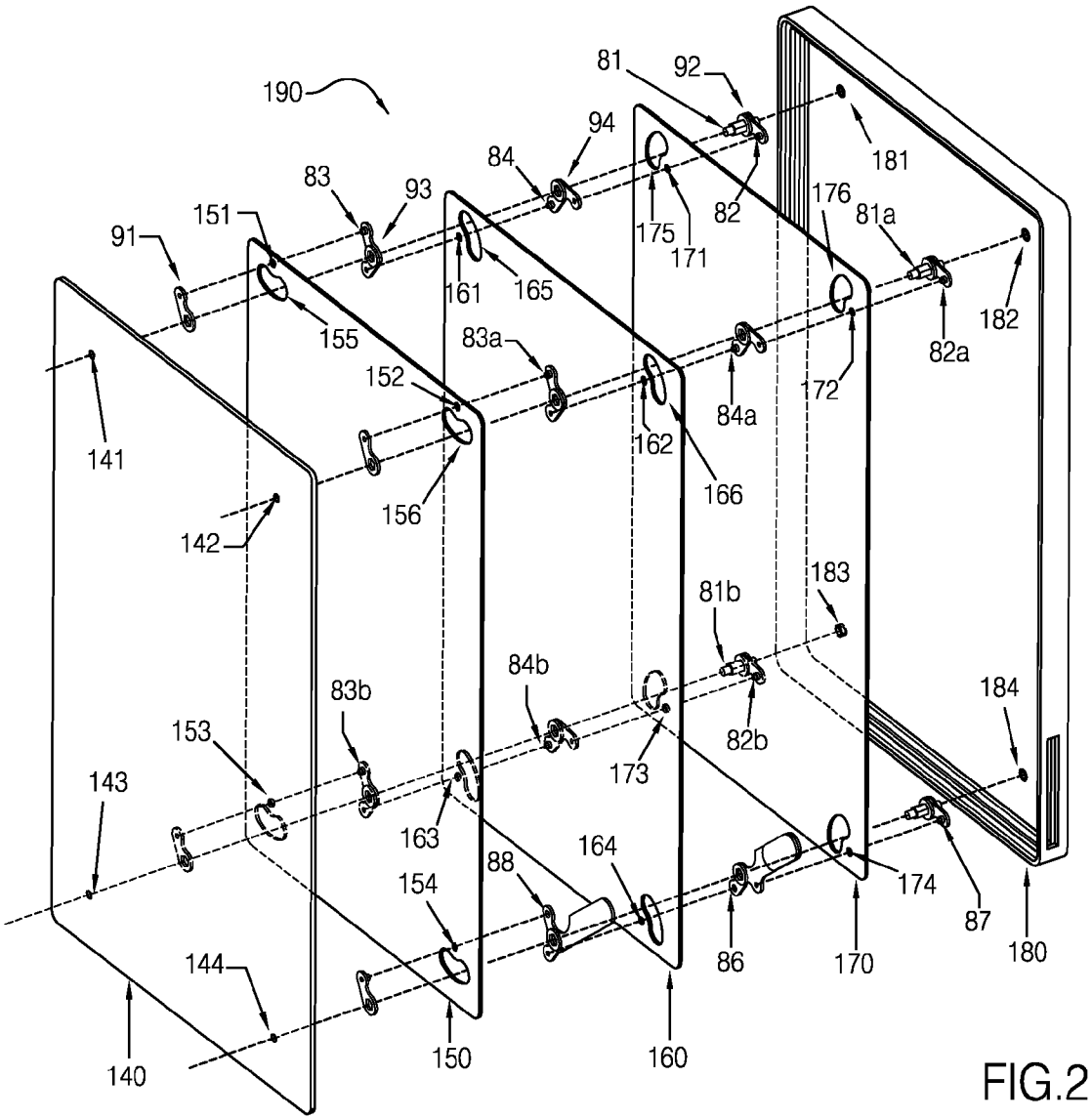
FIG. 21 shows an exploded view of a second panel assembly of the invention.

FIG. 21 shows an exploded view of panel assembly 190 which is comprised of two fixed panels 140 and 180 and three movable panels 150, 160 and 170.

Panel assembly 190 is further comprised of four drive links 80, 80*a*, 80*b* and 85 which are also shown in exploded view.

Outer pivot pin 83 of drive link 80 is aligned with pivot hole 151 of panel 150. Outer pivot pin 84 is aligned with pivot hole 161 of panel 160. Outer pivot 82 is aligned with pivot hole 171 of panel 170.

Center pivot pin 81 aligns with pivot holes 181 and 141 belonging to panels 180 and 140 respectively. Center pivot pin 81 is positioned such that it can slidably pass through slots 155, 165 and 175 allowing clearance for unobstructed movement.

Similarly, outer pivot pin 83*a* of drive link 80*a* is aligned with pivot hole 152 of panel 150. Outer pivot pin 84*a* is aligned with pivot hole 162 of panel 160. Outer pivot 82*a* is aligned with hole 172 of panel 170.

Center pivot pin 81*a* aligns with holes 182 and 142 belonging to panels 180 and 140 respectively. Center pivot pin 81*a* is positioned such that it can pass through slots 156, 166 and 176 allowing clearance for unobstructed movement.

In a similar manner, drive links 80*b* and 85 align with the respective holes and slots belonging to panels 140, 150, 160, 170 and 180.

Figure 22:
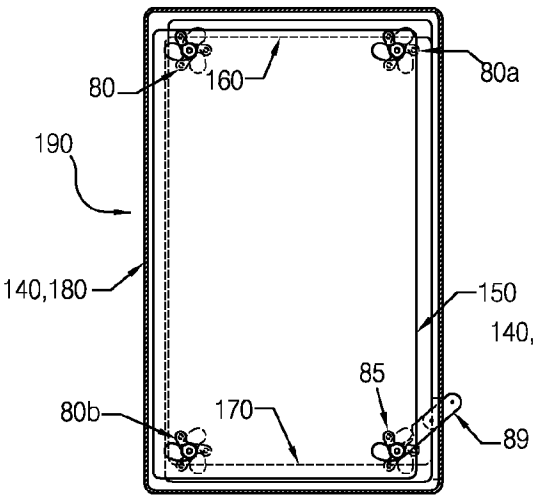

FIG. 22 shows panel assembly 190. Drive links 80, 80*a*, 80*b* and 85 have a consistent rotational position relative to fixed panels 140, 180, thereby setting a first location of movable panels 150, 160 and 170. Handle element 89 belonging to drive link 85 is in a raised position.

Figure 23:
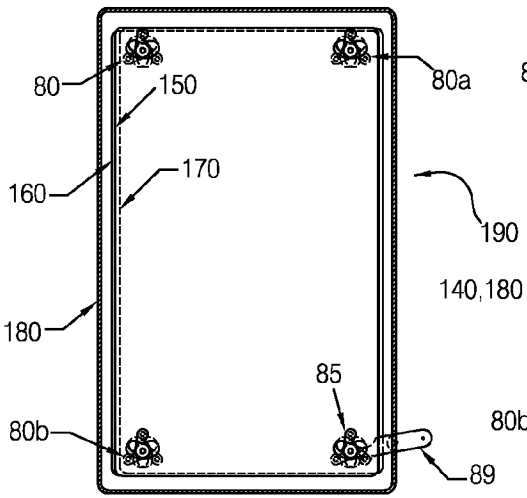

FIG. 23 shows panel assembly 190 in a second position wherein drive links 80, 80*a*, 80*b* and 85 have been further rotated relative to panels 140, 180, thereby providing a translated location of movable panels 150, 160 and 170 relative to FIG. 22. Handle element 89 is in an intermediate position.

Figure 24:
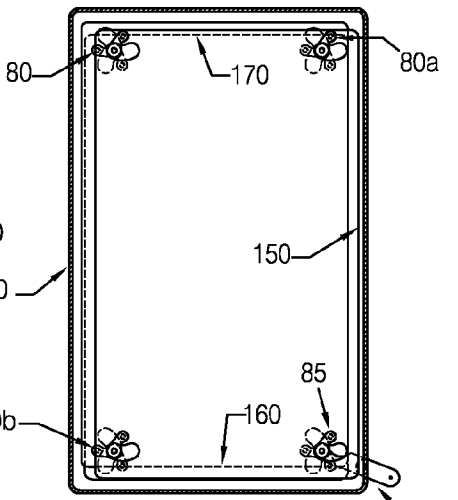
FIGS. 22-24 show plan views of the panel assembly of FIG. 21 as it is transformed from an initial position to a final position.

FIG. 24 shows panel assembly 190 in a third position wherein drive links 80, 80*a*, 80*b* and 85 have been further rotated relative to panels 140, 180, thereby translating the locations of movable panels 150, 160 and 170. Handle element 89 is in a lower position.

It may be seen in FIGS. 22-24 that as panels 150, 160 and 170 are successively moved, the degree to which each movable panel is lowered or raised is essentially counterbalanced by the movements of the other panels. This ensures that the force needed to turn handle 89 is minimized.

Figure 25:
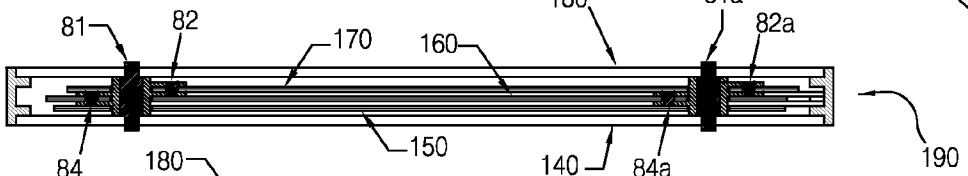
FIGS. 25-26 show a sectional view and a detail plan view respectively of the panel assembly of FIG. 21.

FIG. 25 shows a sectional view of panel assembly 190 wherein center pivot pins 81 and 81*a* may be seen to span between fixed panels 140 and 180. Outer pivot pins 82 and 82*a* engage moveable panel 170; outer pivot pins 84 and 84*a* engage moveable panel 160.

Figure 26:
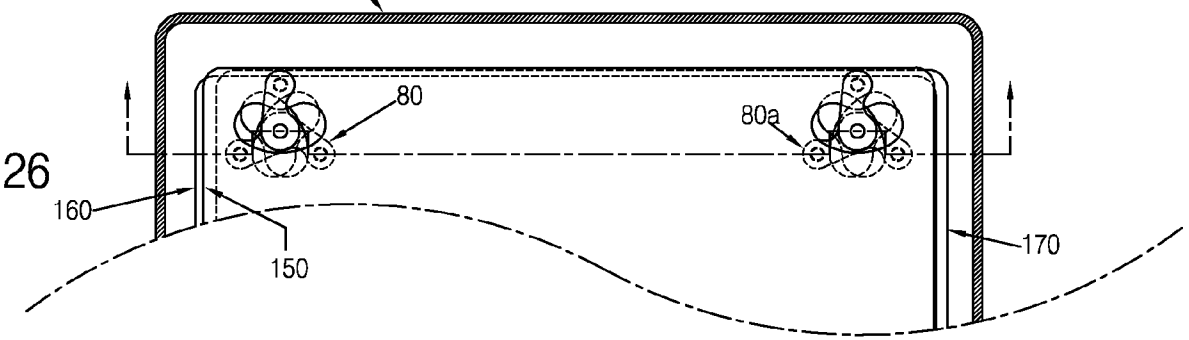

FIG. 26 shows a detailed view of panel assembly 190 in its second position.

Figure 27:
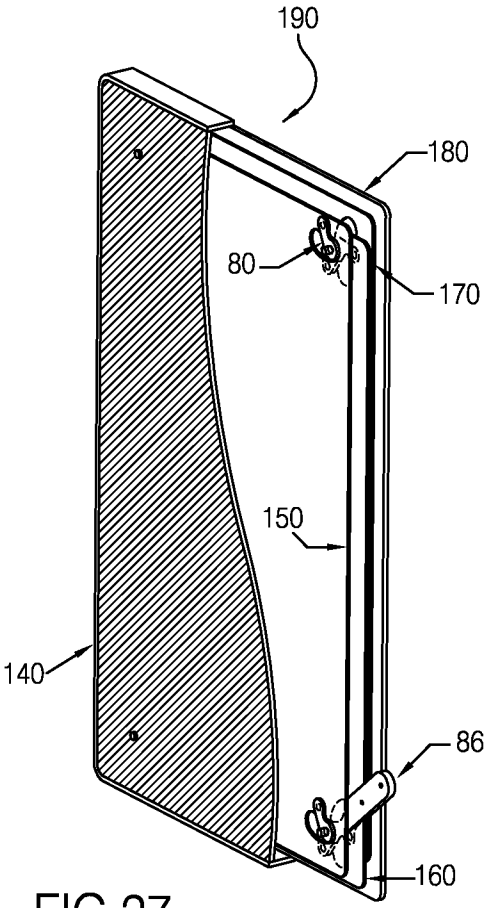

FIG. 27 shows a perspective view of panel assembly 190 in its first position where fixed panel 140 is shown in cutaway to reveal movable panels 150, 160 and 170.

Figure 29:
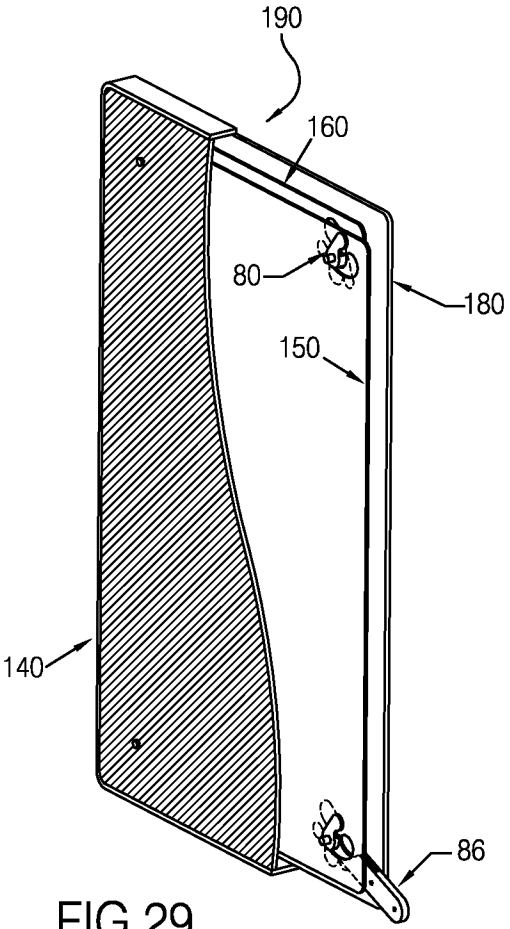
FIGS. 27-29 shows perspective views of the panel assembly of FIG. 21 as it is transformed from an initial position to a final position.
Figure 28:
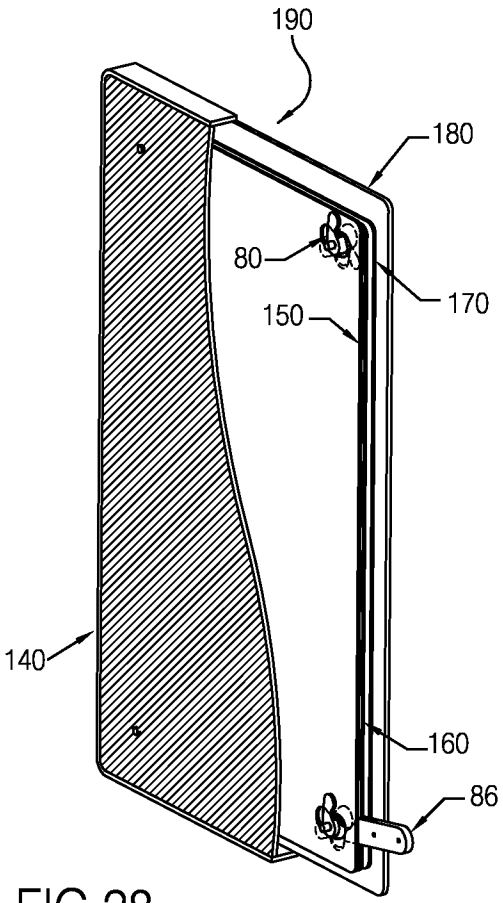

FIGS. 28 and 29 show perspective views of panel assembly 190 in its second and third position respectively.

Figures 30, 31, 32, 33, 34:
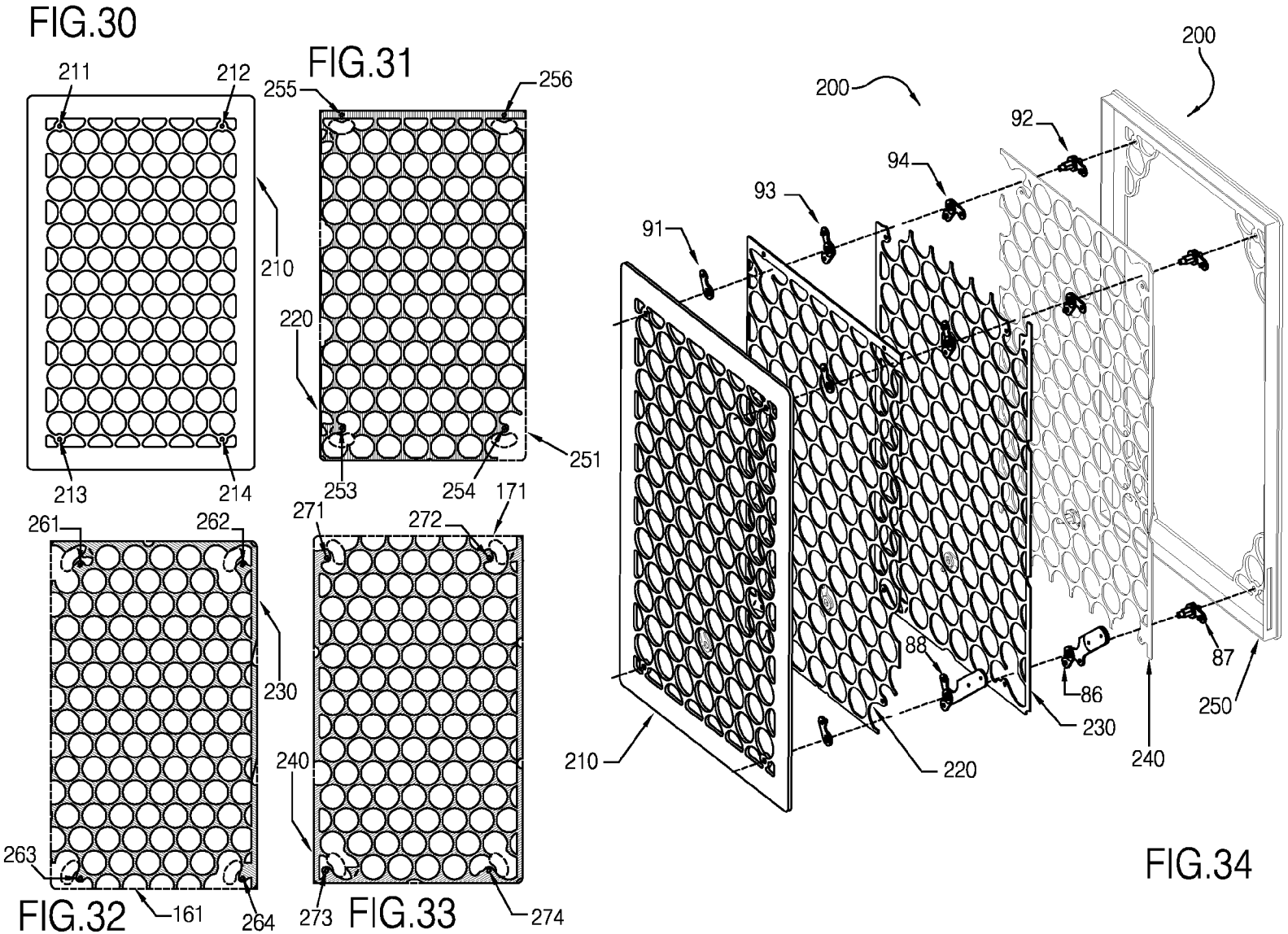
FIGS. 30-33 show plan views of four other panels of the invention, each with circular perforations.
FIG. 34 shows an exploded view of a third panel assembly of the invention.

FIG. 30 shows panel 210 which is perforated with a pattern of circular holes. Panel 210 has a similar outer profile to panel 140. It has four holes 211, 212, 213 and 214 which are located in a similar position relative to its outer profile to holes 141, 142 143 and 144 belonging to panel 140.

FIG. 31 shows perforated panel 220. Also in FIG. 31 is profile 151, shown in dashed line, which corresponds to the outer profile and slots of panel 150. Panel 220 may be seen to align with profile 151. Holes 253, 254, 255 and 256 have identical locations. Holes 153, 154, 155 and 156 are in a similar position relative to profile 151. However, it may be seen that some material is removed from panel 220 relative to profile 151.

FIGS. 32 and 33 show panels 230 and 240 respectively. Panels 230 and 240 may be seen to align with profiles 161 and 172 (shown in dashed line) respectively, which in turn correspond to the outer profiles and slots of panels 160 and 170 respectively.

FIG. 34 shows an exploded view of panel assembly 200, which is comprised of two fixed panels 210 and 250, three movable panels 220, 230 and 240 as well as four drive links 80, 80*a*, 80*b* and 85. Panel assembly 200 may thus be seen to be mechanically identical to panel assembly 190. The essential difference is that the panels belonging to assembly 200 are perforated whereas the panels belonging to assembly 190 are not perforated.

Figure 35:
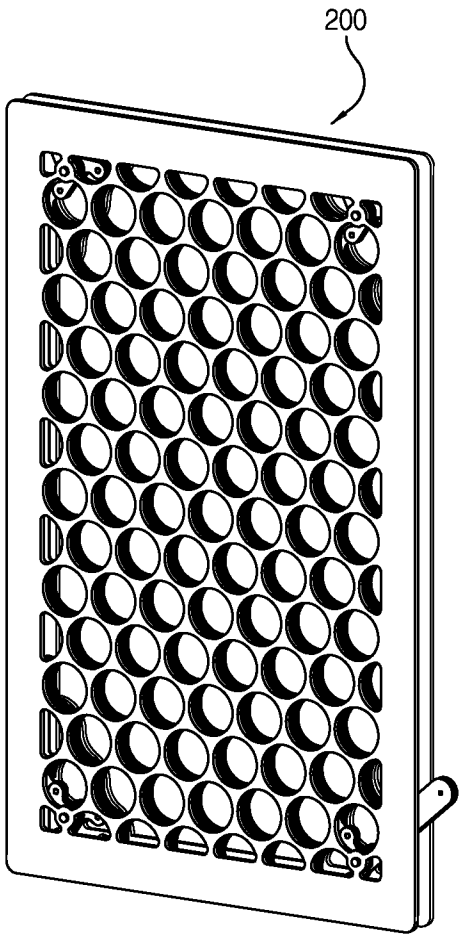

FIG. 35 shows panel assembly 200 is in a first position. Movable panels 220, 230 and 240 are located such that their perforations are aligned with the perforations of fixed panels 210 and 250. In this position, assembly 200 is in an open, non-opaque state.

Figure 36:
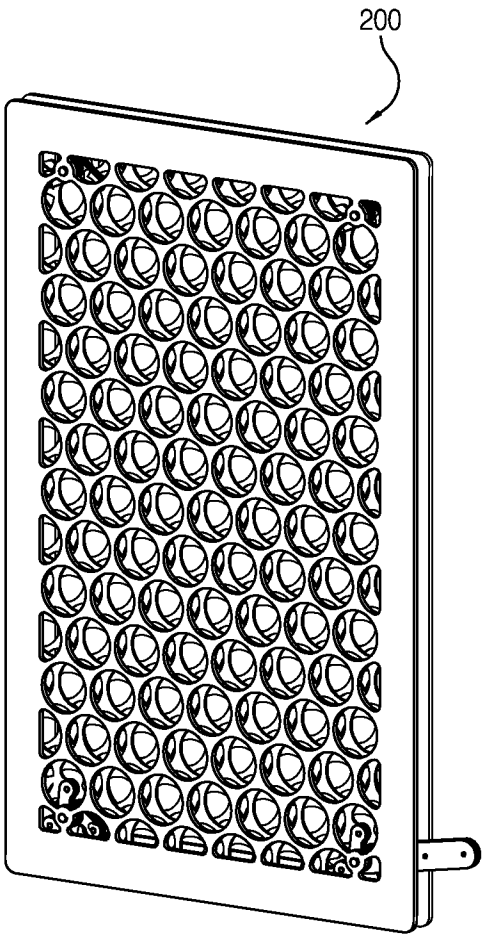

FIG. 36 shows panel assembly 200 is in a second position. Movable panels 220, 230 and 240 are located such that their perforations are partially aligned with the perforations of fixed panels 210 and 250. In this position, assembly 200 is in a partially opaque state.

Figure 37:
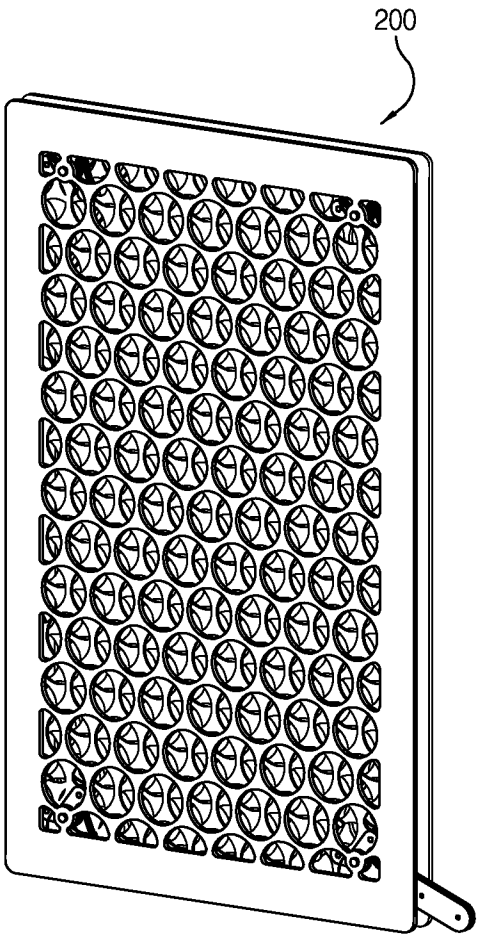
FIGS. 35-37 shows perspective views of the panel assembly of FIG. 34 as it is transformed from an initial, aligned position to a final non-aligned position.

FIG. 37 shows panel assembly 200 is in a third position. Movable panels 220, 230 and 240 are located such that their perforations are not aligned with the perforations of fixed panels 210 and 250, thereby blocking those perforations. In this position, assembly 200 is in a fully opaque state.

FIG. 38 shows a cutaway detail of panel assembly 200 in a first position, wherein the perforations of moveable panels 220, 230 and 240 are aligned with those of fixed panels 210, 250. Handle element 89 belonging to drive link 85 is in an upper position.

FIG. 39 shows a cutaway detail of panel assembly 200 in a second position, wherein the perforations of moveable panels 220, 230 and 240 are partially aligned with those of fixed panels 210, 250. Handle element 89 belonging to drive link 85 is in an intermediate position.

FIG. 40 shows a cutaway detail of panel assembly 200 in a third position, wherein the perforations of moveable panels 220, 230 and 240 are not aligned with those of fixed panels 210, 250. Handle element 89 belonging to drive link 85 is in a lower position.

FIGS. 41, 42 and 43 show plan views of panel assembly 200 in its first, second and third position respectively. It may be seen that panel assembly 200 may be reversibly transformed from a non-opaque, permeable state to an opaque, non-permeable state by raising and lowering handle element 89.

FIG. 44 shows a panel 310 having the same profile and hole locations as panel 140. Panel 310 is made of a transparent material upon which a graphic pattern of opaque circles has been applied.

FIGS. 45-47 show panels 320, 330 and 340 whose profiles, holes and slot locations are essentially identical to panels 150, 160 and 170 respectively. Panels 320, 330 and 340 are made of a transparent material upon which graphic patterns of opaque circles have been applied.

FIG. 48 shows an exploded view of panel assembly 300, which is comprised of two fixed panels 310 and 350, three movable panels 320, 330 and 340 as well as four drive links 80, 80*a*, 80*b* and 85. Panel assembly 300 may thus be seen to be mechanically identical to panel assembly 190. The essential difference is that the panels belonging to assembly 300 are transparent, and have a graphic pattern of opaque circles are applied whereas the panels belonging to assembly 190 are not transparent.

Figure 49:
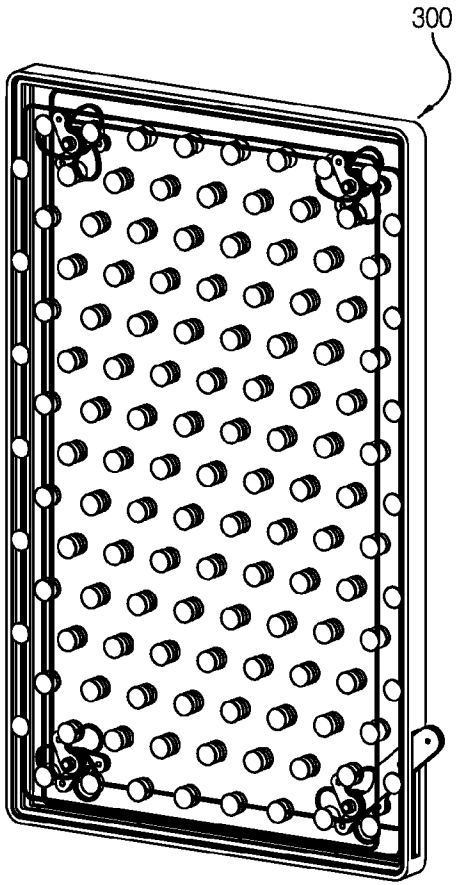

FIG. 49 shows panel assembly 300 is in a first position. Movable panels 320, 330 and 340 are located such that their circles are aligned with the circles of fixed panels 310 and 350. Due to the alignment of these circles, the majority of the surface of assembly 300 is transparent.

Figure 50:
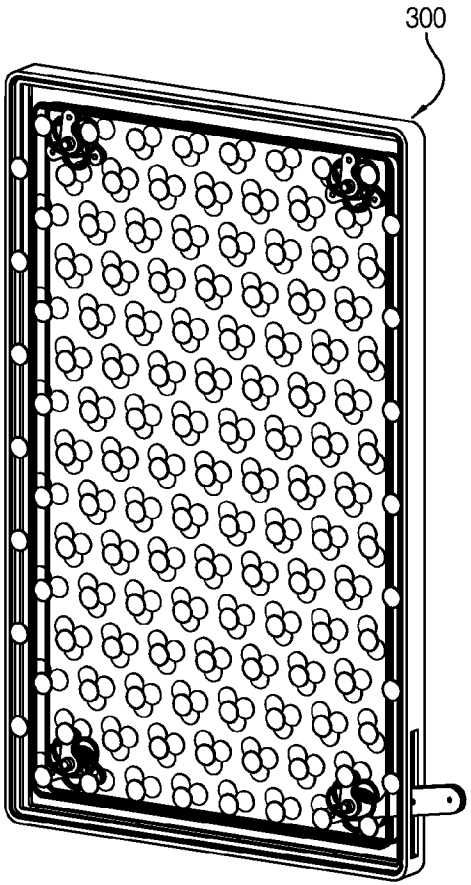

FIG. 50 shows panel assembly 300 is in a second position. Movable panels 320, 330 and 340 are located such that their circles are partially aligned with the circles of fixed panels 310 and 350. In this position, assembly 300 is in a partially opaque state.

Figure 51:
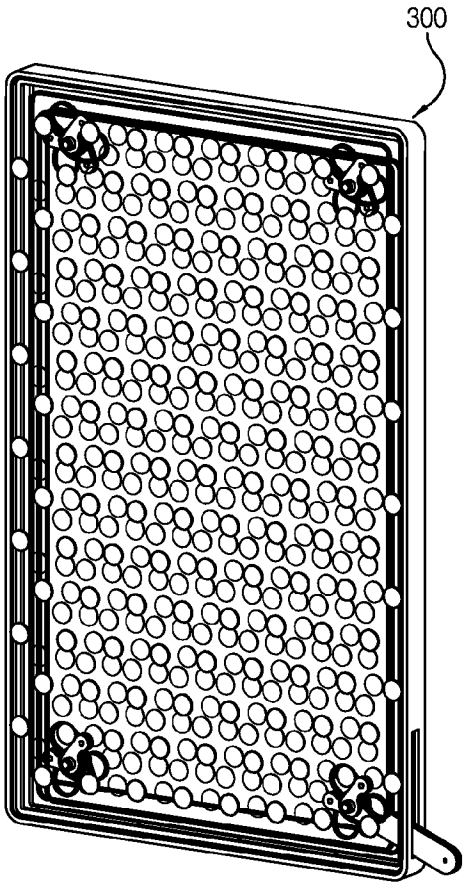
FIGS. 49-51 shows perspective views of the panel assembly of FIG. 48 as it is transformed from an initial, aligned position to a final non-aligned position.

FIG. 51 shows panel assembly 300 is in a third position. Movable panels 320, 330 and 340 are located such that their circles are not aligned with the circles of fixed panels 310 and 350. In this position, assembly 300 is in a largely opaque state.

Figures 52, 53, 54, 55, 56, 57:
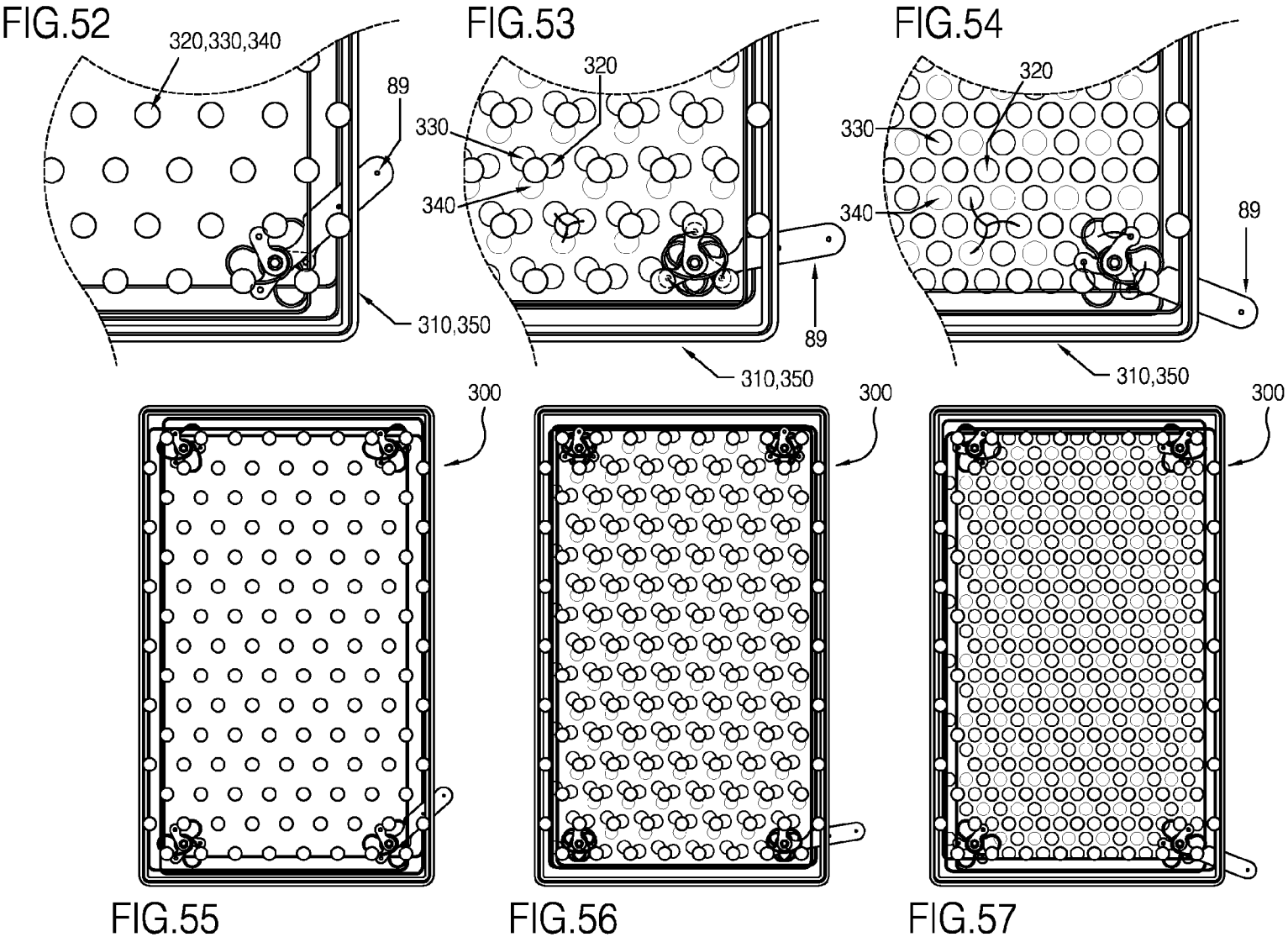
FIGS. 52-54 shows cutaway views of the panel assembly of FIG. 48 as it is transformed from an initial, aligned position to a final non-aligned position.
FIGS. 55-57 shows plan views of the panel assembly of FIG. 48 as it is transformed from an initial, aligned position to a final non-aligned position.

FIG. 52 shows a cutaway detail of panel assembly 300 in a first position, wherein the opaque circles on moveable panels 320, 330 and 340 are aligned with those of fixed panels 310, 350, thereby creating a largely transparent surface. Handle element 89 belonging to drive link 85 is in an upper position.

FIG. 53 shows a cutaway detail of panel assembly 300 in a second position, wherein the perforations of moveable panels 320, 330 and 340 are partially aligned with those of fixed panels 310, 350. Handle element 89 belonging to drive link 85 is in an intermediate position.

FIG. 54 shows a cutaway detail of panel assembly 300 in a third position, wherein the perforations of moveable panels 320, 330 and 340 are not aligned with those of fixed panels 310, 350, thereby creating a largely opaque surface. Handle element 89 belonging to drive link 85 is in a lower position.

FIGS. 55, 56 and 57 show plan views of panel assembly 300 in its first, second and third position respectively. It may be seen that panel assembly 300 may be reversibly transformed from a largely transparent state to a largely opaque state by raising and lowering handle element 89.

Figure 58:
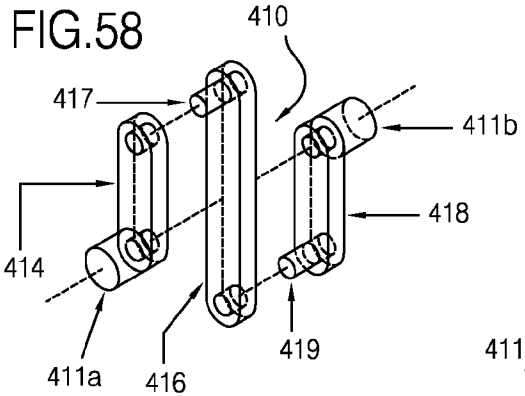
FIGS. 58-59 show exploded and perspective views, respectively, of a fourth drive link of the invention.

FIG. 58 shows a drive link 410 which is comprised of three sub-links 414, 416 and 418. Drive link 410 is further comprised of center pivot pins 411*a*, 411*b* and outer pivot pins 417 and 419.

Figure 59:
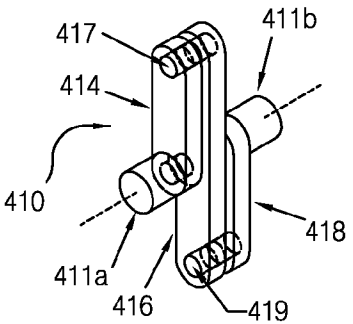

FIG. 59 shows a perspective view of drive link 410. Center pivot pin 411*a* is co-linear, yet discontinuous, with center pivot pin 411*b*. Sub-links 414,416 share outer pivot pin 417. Sub-links 416,418 share outer pivot pin 419.

Figure 60:
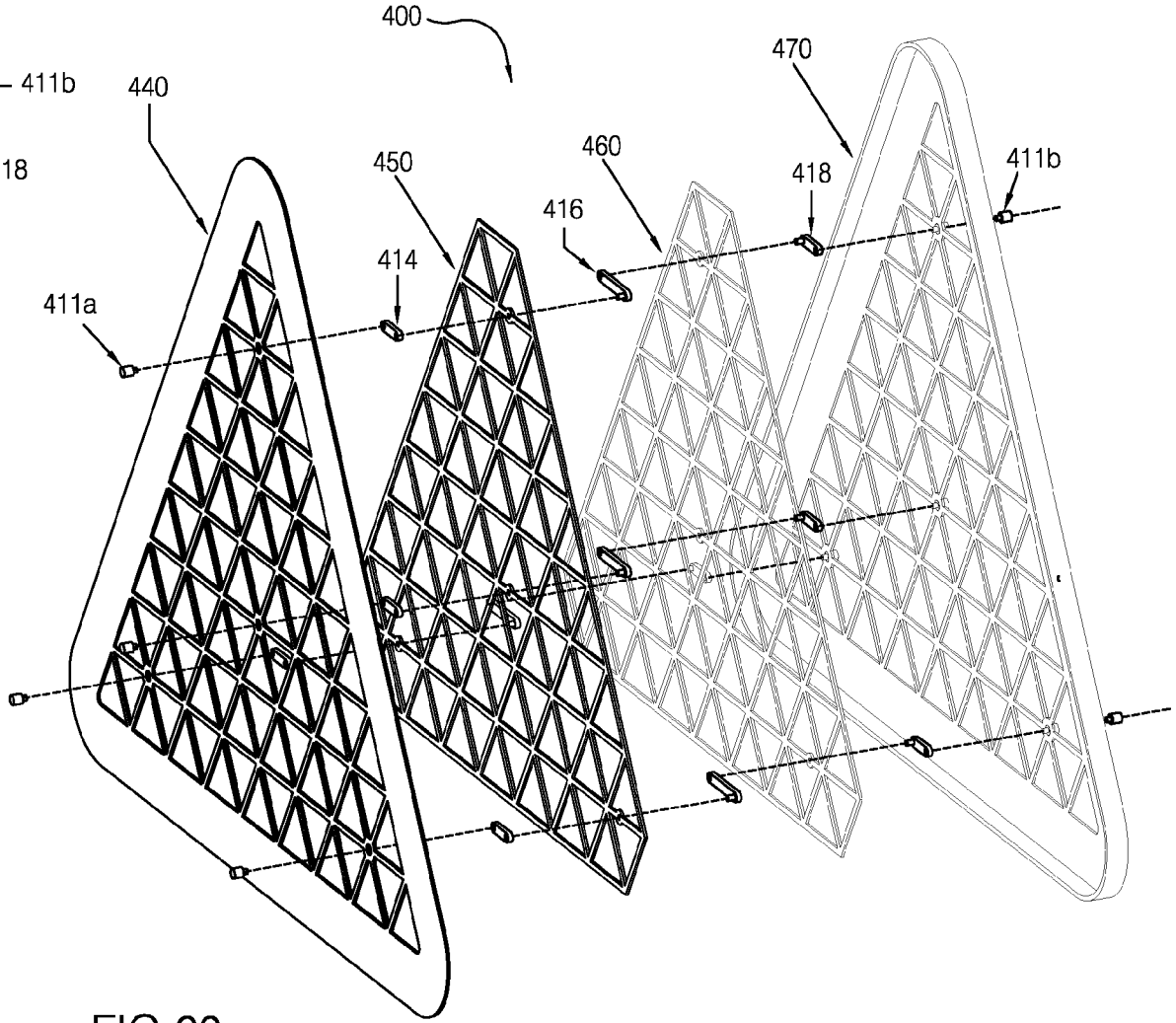
FIG. 60 shows an exploded view of a fifth panel assembly of the invention.

FIG. 60 shows an exploded view of panel assembly 400 which is comprised of fixed panels 440,470 and movable panels 450,460. Panel assembly 400 has an essentially triangular perimeter. Panels 440,450,460 and 470 have triangular perforations.

Figure 61:
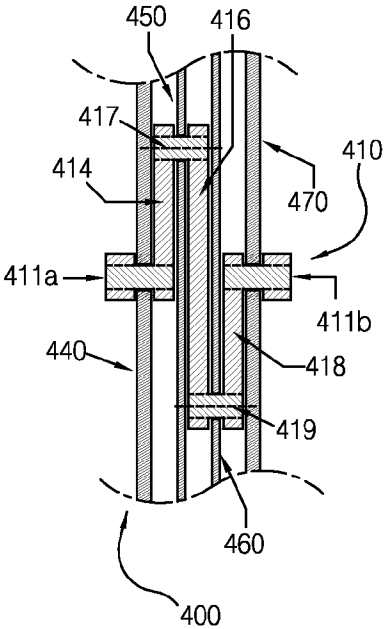
FIG. 61 shows a sectional view of the panel assembly of FIG. 60.
Figure 67:
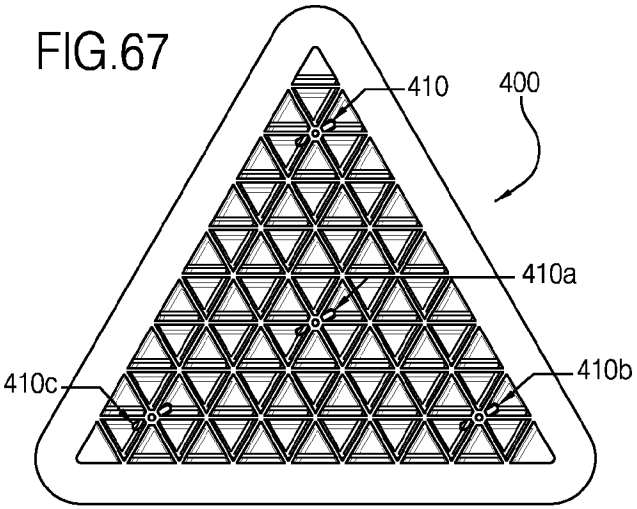
FIGS. 66-69 show plan views of the panel assembly of FIG. 60 as it is transformed from an initial, aligned position to a final non-aligned position.
Figure 69:
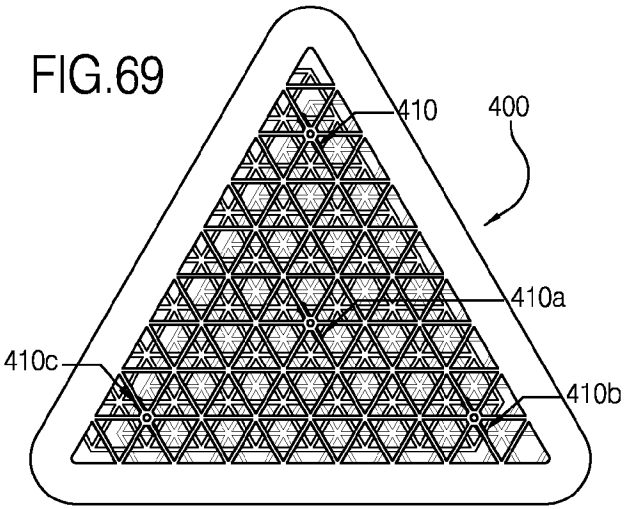
Figure 66:
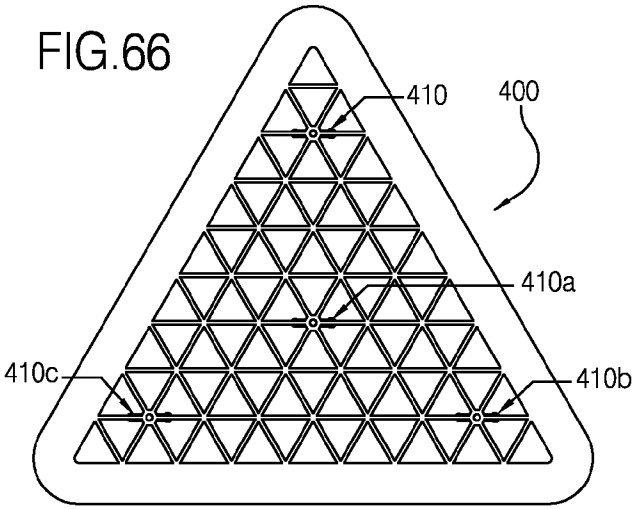
Figure 68:
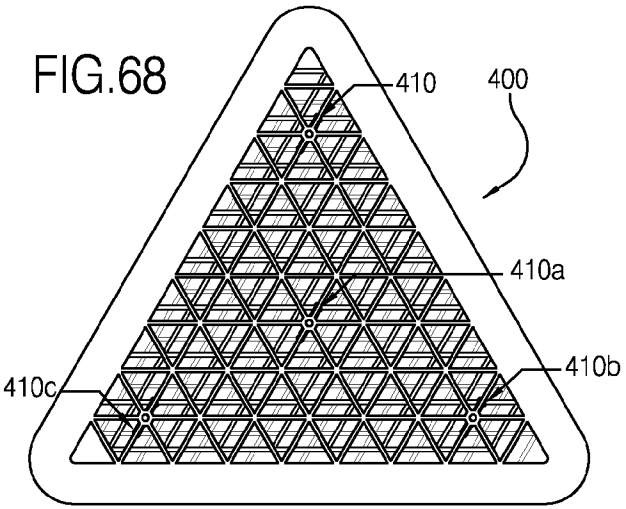

FIG. 61 shows a sectional view of assembly 400. Center pivot pin 411*a* engages fixed panel 440; outer pivot pin 417 engages movable panel 450; outer pivot pin 419 engages movable panel 460; center pivot pin 411*b* engages fixed panel 470. Sub-link and sub-link 414, 416 and 418 lie in different planes relative to each another. Likewise, outer pivot pins 417 and 419 lie in different planes.

None of the four pivot pins 411*a*, 417, 419 or 411*b* spans beyond the particular panel with which they engage. Therefore, it is unnecessary to provide clearance slots in the fixed or movable panels to allow unobstructed movement. Further, drive link 410 can be rotated a full three-hundred and sixty degrees in a continuous manner.

Figure 62:
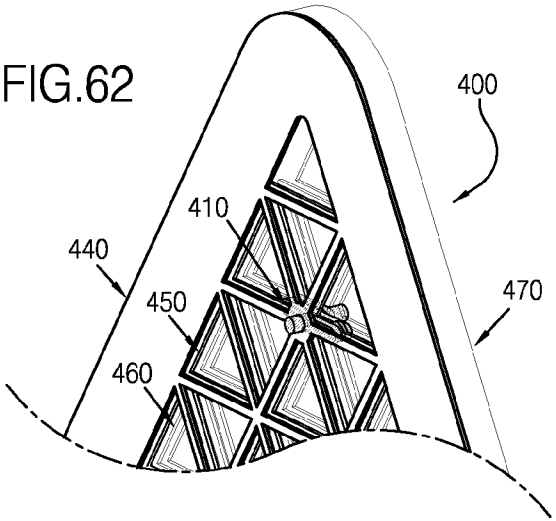

FIG. 62 shows a detailed perspective view of panel assembly 400 in its aligned position. Drive link 410 shown in dashed line may be seen to engage panels 440,450,460 and 470.

Figure 63:
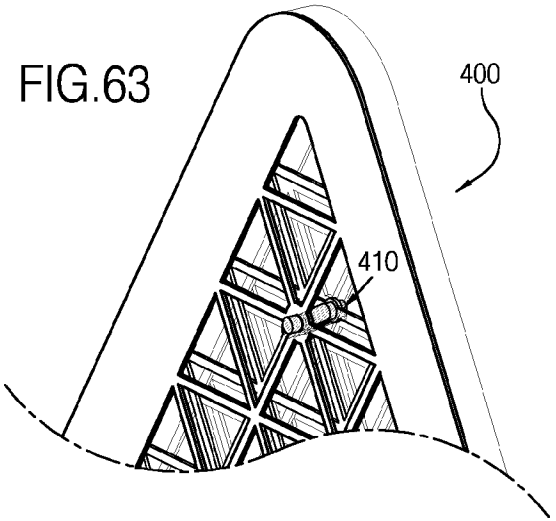
FIGS. 62-65 show detailed perspective views of the panel assembly of FIG. 60 as it is transformed from an initial, aligned position to a final non-aligned position.
Figure 64:
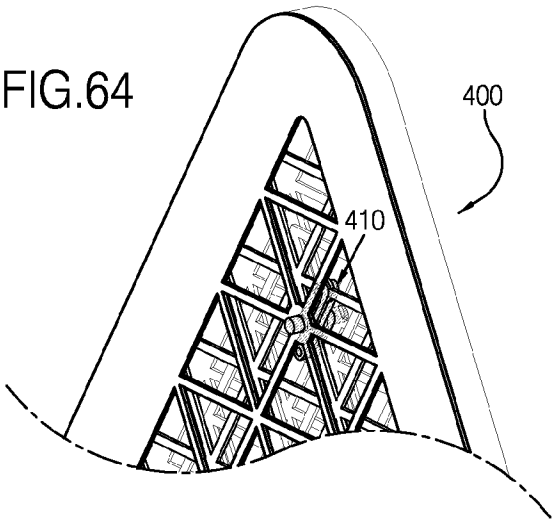

FIGS. 63 and 64 show panel assembly 400 in a successive partially aligned positions where drive link 410 has been successively rotated relative to its position in FIG. 62.

Figure 65:
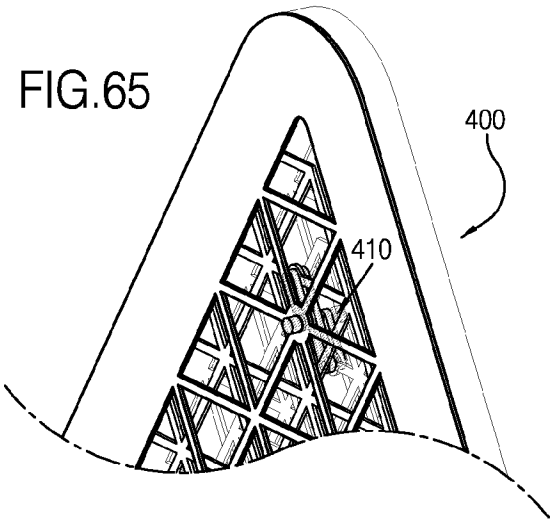

FIG. 65 shows panel assembly 400 in a non-aligned position.

FIGS. 66 through 69 show four views of panel assembly 400 as it transforms from an aligned, largely permeable condition to a non-aligned largely non-permeable condition.

Assembly 400 has three drive links 410, 410*b* and 410*c* which are located near the perimeter of the assembly. It has one drive link 410*a* which is located at the center of assembly 400.

Not shown, but possible, are panel assemblies that are comprised of sheets having different acoustical properties, whether absorptive or reflective.

The invention claimed is:

1. A panel assembly comprising:

two fixed panels each having two spaced apart pivot holes, each fixed panel positioned on an opposite end of the panel assembly;

a first overlying moveable panel having two spaced apart pivot holes;

a second overlying moveable panel having two spaced apart pivot holes;

two drive links with each drive link having one center pivot pin and two outer pivot pins;

wherein the center pivot pin of each said drive link pivotally engages respectively the two pivot holes of each said fixed panel;

wherein one of the outer pivot pins of each said drive link pivotally engages respectively the two pivot holes of one of said moveable panels;

wherein the other of the outer pivot pins of each said drive link pivotally engages respectively the two pivot holes of the other of said moveable panels; and wherein rotation of the two drive links causes the two moveable panels to move relative to each other and to said fixed panels between a first aligned position and a second non-aligned position; and wherein the two drive links and respective pivot pins are arranged and constructed to define an effective radius of rotation for each of said moveable panels during rotation, said effective radii being approximately equal causing all said movable panels to move concentrically around said central pins at said radii of rotation.

2. An assembly according to claim 1: wherein said panels are made of a perforated material such that in said first position, the perforations of said panels are aligned for providing a largely permeable condition, and in said second position, the perforations are not aligned for providing a largely non-permeable condition.

3. An assembly according to claim 1:

wherein said panels are made of a transparent material having a surface graphic pattern such that in said first position, the graphic pattern of the panels are aligned providing a largely transparent condition, and in said second position, the graphic patterns are not aligned for providing a largely opaque condition.

4. An assembly according to claim 1:

wherein said first moveable panel has a pair of slots in which the other of said outer pivot pins respectively are slidably received; and wherein said second moveable panel has a pair of slots in which said one of the outer pivot pins respectively are slidably received.

5. An assembly according to claim 1, further including a handle, the turning of which causes rotation of the two drive links.

6. An assembly according to claim 1, further including a motor, the activation of which causes the rotation of the two drive links.

7. An assembly according to claim 1: wherein one or more drive links are capable of continuous unobstructed rotation.

8. An assembly according to claim 1: wherein the panels have a shape selected from the group consisting of rectangular and non-rectangular polygons.

9. An assembly according to claim 1: wherein at least one of the drive links is comprised of at least two sub-links, wherein each of said sub-links connects between the center pivot pin and one of the two outer pivot pins.

10. An assembly according to claim 9: wherein each sub-link lies in a different plane.

11. An assembly according to claim 10:

wherein one of said drive links has a depth such that the outer pivot pins span said depth.

12. An assembly according to claim 10: wherein one of said drive links has a depth such that the center pivot pins span said depth.

13. An assembly according to claim 10:

wherein for at least one of the drive links, the center pivot pin is comprised of two or more co-linear, yet discontinuous, pivot pins.

14. An assembly according to claim 10:

wherein each outer pivot pin lies in a different plane.

15. An assembly according to claim 1: wherein an upward movement of said first moveable panel is counterbalanced by a downward movement of said second moveable panel.

16. An assembly according to claim 1 wherein each drive link includes a first sublink extending from said center pivot pin to one of said outer pivot pins and a second sublink extending from said central pivot pin to the other of said outer pivot pins.

17. An assembly according to claim 16 wherein said first and second sublinks are axially spaced from each other along said center pivot pin.

* * * * *